US009410474B2

(12) United States Patent
McAlister et al.

(10) Patent No.: US 9,410,474 B2
(45) Date of Patent: Aug. 9, 2016

(54) INTEGRATED FUEL INJECTOR IGNITERS CONFIGURED TO INJECT MULTIPLE FUELS AND/OR COOLANTS AND ASSOCIATED METHODS OF USE AND MANUFACTURE

(71) Applicants: McAlister Technologies, LLC, Phoenix, AZ (US); Roy Edward McAlister, Phoenix, AZ (US)

(72) Inventors: Roy Edward McAlister, Phoenix, AZ (US); Melvin James Larsen, Chandler, AZ (US)

(73) Assignee: McAlister Technologies, LLC, Phoenix, AZ (US)

( * ) Notice: Subject to any disclaimer, the term of this patent is extended or adjusted under 35 U.S.C. 154(b) by 224 days.

(21) Appl. No.: 13/864,192

(22) Filed: Apr. 16, 2013

(65) Prior Publication Data

US 2014/0102407 A1 Apr. 17, 2014

Related U.S. Application Data

(63) Continuation of application No. 12/961,461, filed on Dec. 6, 2010, now abandoned.

(51) Int. Cl.
*F02B 17/00* (2006.01)
*F02M 43/04* (2006.01)
(Continued)

(52) U.S. Cl.
CPC ..... *F02B 17/005* (2013.01); *F02M 43/04* (2013.01); *F02M 53/043* (2013.01);
(Continued)

(58) Field of Classification Search
CPC . F02M 21/0275; F02M 55/008; F02M 57/06; F02M 43/04; F02M 53/043; F02D 19/0694; F02B 17/005
See application file for complete search history.

(56) References Cited

U.S. PATENT DOCUMENTS 1,307,088 A 6/1919 Drummond
1,451,384 A 4/1923 Whyte
(Continued)

FOREIGN PATENT DOCUMENTS

CN 1589369 A 3/2005
CN 102906227 A 1/2013
(Continued)

OTHER PUBLICATIONS

"Ford DIS/EDIS "Waste Spark" Ignition System." Accessed: Jul. 15, 2010. Printed: Jun. 8, 2011. <http://rockledge.home.comcast.net/~rockledge/RangerPictureGallery/DIS_EDIS.htm>. pp. 1-6.
(Continued)

*Primary Examiner* — Ryan Reis
(74) *Attorney, Agent, or Firm* — Perkins Coie LLP

(57) ABSTRACT

Embodiments of injectors configured for adaptively injecting multiple different fuels and coolants into a combustion chamber, and for igniting the different fuels, are disclosed herein. An injector according to one embodiment includes a body having a first end portion and a second end portion. The injector further includes a first flow channel extending through the body, and a second flow channel extending through the body that is separate from the first flow channel and electrically isolated from the first flow channel. The first flow channel is configured to receive a first fuel, and the second flow channel is configured to receive at least one of a second fuel and a coolant. The injector further comprises a valve carried by the body that is movable between a closed position and an open position to introduce at least one of the second fuel and the coolant into a combustion chamber.

9 Claims, 4 Drawing Sheets

(51) Int. Cl.

| | |
|---|---|
| ***F02M 53/04*** | (2006.01) |
| ***F02M 55/00*** | (2006.01) |
| ***F02M 57/06*** | (2006.01) |
| *F02M 61/04* | (2006.01) |
| *F02M 61/08* | (2006.01) |

(52) U.S. Cl.

CPC ..... *F02M 55/008* (2013.01); *F02M 57/06* (2013.01); *F02M 61/045* (2013.01); *F02M 61/08* (2013.01); *F02M 2700/077* (2013.01)

(56) References Cited

U.S. PATENT DOCUMENTS 1,765,237 A 6/1930 King
2,068,038 A 1/1937 Prothero et al.
2,215,793 A 9/1940 Mayes
2,255,203 A 9/1941 Wiegand
2,441,277 A 5/1948 Lamphere
2,681,212 A 6/1954 Thomas
2,721,100 A 10/1955 Bodine, Jr.
2,744,507 A 5/1956 Huber
2,864,974 A 12/1958 Beye
3,058,453 A 10/1962 May
3,060,912 A 10/1962 May
3,081,758 A 3/1963 May
3,243,335 A 3/1966 Faile
3,286,164 A 11/1966 De Huff
3,373,724 A 3/1968 Papst
3,391,680 A 7/1968 Benson
3,520,961 A 7/1970 Suda et al.
3,551,738 A 12/1970 Young
3,594,877 A 7/1971 Suda et al.
3,608,050 A 9/1971 Carman et al.
3,689,293 A 9/1972 Beall
3,696,795 A 10/1972 Smith et al.
3,745,887 A 7/1973 Striegl
3,789,807 A 2/1974 Pinkerton
3,866,074 A 2/1975 Smith
3,926,169 A 12/1975 Leshner et al.
3,931,438 A 1/1976 Beall et al.
3,958,540 A 5/1976 Siewert
3,960,995 A 6/1976 Kourkene
3,976,039 A 8/1976 Henault
3,980,056 A 9/1976 Kraus
3,997,352 A 12/1976 Beall
4,020,803 A 5/1977 Thuren et al.
4,041,910 A 8/1977 Houseman
4,062,338 A 12/1977 Toth
4,066,046 A 1/1978 McAlister
4,087,719 A 5/1978 Pratt, Jr.
4,095,580 A 6/1978 Murray et al.
4,105,004 A 8/1978 Asai et al.
4,116,389 A 9/1978 Furtah et al.
4,122,816 A 10/1978 Fitzgerald et al.
4,135,481 A 1/1979 Resler, Jr.
RE29,978 E 5/1979 Leshner et al.
4,172,921 A 10/1979 Kiefer
4,183,467 A 1/1980 Sheraton et al.
4,203,393 A 5/1980 Giardini
4,281,797 A 8/1981 Kimata et al.
4,288,981 A 9/1981 Wright
4,293,188 A 10/1981 McMahon
4,303,045 A 12/1981 Austin, Jr.
4,330,732 A 5/1982 Lowther
4,332,223 A 6/1982 Dalton
4,364,342 A 12/1982 Asik
4,364,363 A 12/1982 Miyagi et al.
4,368,707 A 1/1983 Leshner et al.
4,377,455 A 3/1983 Kadija et al.
4,381,740 A 5/1983 Crocker
4,382,189 A 5/1983 Wilson
4,391,914 A 7/1983 Beall
4,413,474 A 11/1983 Moscrip
4,432,310 A 2/1984 Waller
4,448,160 A * 5/1984 Vosper ..... 123/297
4,469,160 A 9/1984 Giamei
4,481,160 A 11/1984 Bree
4,483,485 A 11/1984 Kamiya et al.
4,511,612 A 4/1985 Huther et al.
4,528,270 A 7/1985 Matsunaga
4,536,452 A 8/1985 Stempin et al.
4,553,508 A 11/1985 Stinebaugh
4,567,857 A 2/1986 Houseman et al.
4,574,037 A 3/1986 Samejima et al.
4,677,960 A 7/1987 Ward
4,684,211 A 8/1987 Weber et al.
4,688,538 A 8/1987 Ward et al.
4,700,891 A 10/1987 Hans et al.
4,716,874 A 1/1988 Hilliard et al.
4,733,646 A 3/1988 Iwasaki
4,736,718 A 4/1988 Linder
4,742,265 A 5/1988 Giachino et al.
4,760,818 A 8/1988 Brooks et al.
4,760,820 A 8/1988 Tozzi
4,774,914 A 10/1988 Ward
4,774,919 A 10/1988 Matsuo et al.
4,777,925 A 10/1988 LaSota
4,834,033 A 5/1989 Larsen
4,841,925 A 6/1989 Ward
4,884,533 A 12/1989 Risitano et al.
4,922,883 A 5/1990 Iwasaki
4,932,263 A 6/1990 Wlodarczyk
4,967,708 A 11/1990 Linder et al.
4,977,873 A 12/1990 Cherry et al.
4,979,406 A 12/1990 Waller
4,982,708 A 1/1991 Stutzenberger
5,034,852 A 7/1991 Rosenberg
5,035,360 A 7/1991 Green et al.
5,036,669 A 8/1991 Earleson et al.
5,055,435 A 10/1991 Hamanaka et al.
5,056,496 A 10/1991 Morino et al.
5,069,189 A 12/1991 Saito
5,072,617 A 12/1991 Weiss
5,076,223 A 12/1991 Harden et al.
5,095,742 A 3/1992 James et al.
5,107,673 A 4/1992 Sato et al.
5,109,817 A 5/1992 Cherry
5,125,366 A 6/1992 Hobbs
5,131,376 A 7/1992 Ward et al.
5,150,682 A 9/1992 Magnet
5,178,119 A 1/1993 Gale
5,193,515 A 3/1993 Oota et al.
5,207,208 A 5/1993 Ward
5,211,142 A 5/1993 Matthews et al.
5,220,901 A 6/1993 Morita et al.
5,222,481 A 6/1993 Morikawa
5,267,601 A 12/1993 Dwivedi
5,297,518 A 3/1994 Cherry
5,305,360 A 4/1994 Remark et al.
5,328,094 A 7/1994 Goetzke et al.
5,329,606 A 7/1994 Andreassen
5,343,699 A 9/1994 McAlister
5,345,906 A 9/1994 Luczak
5,377,633 A 1/1995 Wakeman
5,390,546 A 2/1995 Wlodarczyk
5,392,745 A 2/1995 Beck
5,394,838 A 3/1995 Chandler
5,394,852 A 3/1995 McAlister
5,421,195 A 6/1995 Wlodarczyk
5,421,299 A 6/1995 Cherry
5,435,286 A 7/1995 Carroll, III et al.
5,439,532 A 8/1995 Fraas
5,456,241 A 10/1995 Ward
5,458,292 A * 10/1995 Hapeman ..... F02M 45/086 239/533.4
5,475,772 A 12/1995 Hung et al.
5,497,744 A 3/1996 Nagaosa et al.
5,517,961 A 5/1996 Ward
5,531,199 A * 7/1996 Bryant et al. ..... 123/297
5,549,746 A 8/1996 Scott et al.
5,568,801 A 10/1996 Paterson et al.
5,584,490 A 12/1996 Inoue et al.
5,588,299 A * 12/1996 DeFreitas ..... 60/740
5,605,125 A 2/1997 Yaoita

(56) References Cited

U.S. PATENT DOCUMENTS 5,607,106 A 3/1997 Bentz et al.
5,608,832 A 3/1997 Pfandl et al.
5,647,309 A 7/1997 Avery
5,662,389 A 9/1997 Truglio et al.
5,676,026 A 10/1997 Tsuboi et al.
5,694,761 A 12/1997 Griffin, Jr.
5,699,253 A 12/1997 Puskorius et al.
5,702,761 A 12/1997 DiChiara, Jr. et al.
5,704,321 A 1/1998 Suckewer et al.
5,704,553 A 1/1998 Wieczorek et al.
5,714,680 A 2/1998 Taylor et al.
5,715,788 A * 2/1998 Tarr et al. ..... 123/297
5,733,105 A 3/1998 Beckett et al.
5,738,818 A 4/1998 Atmur et al.
5,745,615 A 4/1998 Atkins et al.
5,746,171 A 5/1998 Yaoita
5,767,026 A 6/1998 Kondoh et al.
5,797,427 A 8/1998 Buescher
5,806,581 A 9/1998 Haasch et al.
5,816,217 A 10/1998 Wong
5,853,175 A 12/1998 Udagawa
5,863,326 A 1/1999 Nause et al.
5,876,659 A 3/1999 Yasutomi et al.
5,915,272 A 6/1999 Foley et al.
5,930,420 A 7/1999 Atkins et al.
5,941,207 A 8/1999 Anderson et al.
5,947,091 A 9/1999 Krohn et al.
5,975,032 A 11/1999 Iwata
5,975,433 A 11/1999 Hasegawa et al.
5,983,855 A 11/1999 Benedikt et al.
6,000,628 A 12/1999 Lorraine
6,015,065 A 1/2000 McAlister
6,017,390 A 1/2000 Charych et al.
6,021,573 A 2/2000 Kikuchi et al.
6,026,568 A 2/2000 Atmur et al.
6,029,627 A 2/2000 VanDyne
6,042,028 A 3/2000 Xu
6,062,498 A 5/2000 Klopfer
6,065,692 A 5/2000 Brinn, Jr.
6,081,183 A 6/2000 Mading et al.
6,085,990 A 7/2000 Augustin
6,092,501 A 7/2000 Matayoshi et al.
6,092,507 A 7/2000 Bauer et al.
6,093,338 A 7/2000 Tani et al.
6,102,303 A 8/2000 Bright et al.
6,131,607 A 10/2000 Cooke
6,138,639 A 10/2000 Hiraya et al.
6,155,212 A 12/2000 McAlister
6,157,011 A 12/2000 Lai
6,173,913 B1 1/2001 Shafer et al.
6,176,075 B1 1/2001 Griffin, Jr.
6,185,355 B1 2/2001 Hung
6,186,419 B1 2/2001 Kampmann et al.
6,189,522 B1 2/2001 Moriya
6,202,416 B1 3/2001 Gray, Jr.
6,253,728 B1 7/2001 Matayoshi et al.
6,267,307 B1 7/2001 Pontoppidan
6,281,976 B1 8/2001 Taylor et al.
6,318,306 B1 11/2001 Komatsu
6,335,065 B1 1/2002 Steinlage et al.
6,338,445 B1 1/2002 Lambert et al.
6,340,015 B1 1/2002 Benedikt et al.
6,360,721 B1 3/2002 Schuricht et al.
6,378,485 B2 4/2002 Elliott
6,386,178 B1 5/2002 Rauch
6,436,196 B1 8/2002 Buchanan et al.
6,446,597 B1 9/2002 McAlister
6,453,660 B1 9/2002 Johnson et al.
6,455,173 B1 9/2002 Marijnissen et al.
6,455,451 B1 9/2002 Brodkin et al.
6,478,007 B2 11/2002 Miyashita et al.
6,483,311 B1 11/2002 Ketterer et al.
6,487,858 B2 12/2002 Cammack
6,490,391 B1 12/2002 Zhao et al.
6,501,875 B2 12/2002 Zhao et al.
6,503,584 B1 1/2003 McAlister
6,506,336 B1 1/2003 Beall et al.
6,516,114 B2 2/2003 Zhao et al.
6,517,011 B1 2/2003 Ayanji et al.
6,517,623 B1 2/2003 Brodkin et al.
6,532,315 B1 3/2003 Hung et al.
6,536,405 B1 3/2003 Rieger et al.
6,542,663 B1 4/2003 Zhao et al.
6,543,700 B2 4/2003 Jameson et al.
6,549,713 B1 4/2003 Pi et al.
6,550,458 B2 4/2003 Yamakado et al.
6,556,746 B1 4/2003 Zhao et al.
6,561,168 B2 5/2003 Hokao et al.
6,567,599 B2 5/2003 Hung
6,568,362 B2 5/2003 Whealton et al.
6,571,035 B1 5/2003 Pi et al.
6,578,775 B2 6/2003 Hokao
6,583,901 B1 6/2003 Hung
6,584,244 B2 6/2003 Hung
6,585,171 B1 7/2003 Boecking
6,587,239 B1 7/2003 Hung
6,599,028 B1 7/2003 Shu et al.
6,606,970 B2 8/2003 Patton
6,615,810 B2 9/2003 Funk et al.
6,615,899 B1 9/2003 Woodward et al.
6,619,269 B1 9/2003 Stier et al.
6,621,964 B2 9/2003 Quinn et al.
6,637,382 B1 10/2003 Brehob et al.
6,647,948 B2 11/2003 Kyuuma et al.
6,663,027 B2 12/2003 Jameson et al.
6,668,630 B1 12/2003 Kuglin et al.
6,672,277 B2 1/2004 Yasuoka et al.
6,687,597 B2 2/2004 Sulatisky et al.
6,700,306 B2 3/2004 Nakamura et al.
6,705,274 B2 3/2004 Kubo
6,712,035 B2 3/2004 Gottemoller et al.
6,719,224 B2 4/2004 Enomoto et al.
6,722,339 B2 4/2004 Elliott
6,722,340 B1 4/2004 Sukegawa et al.
6,722,840 B2 4/2004 Fujisawa et al.
6,725,826 B2 4/2004 Esteghlal
6,742,482 B2 6/2004 Artola
6,745,744 B2 6/2004 Suckewer et al.
6,748,918 B2 6/2004 Rieger et al.
6,749,043 B2 6/2004 Brown et al.
6,755,175 B1 6/2004 McKay et al.
6,756,140 B1 6/2004 McAlister
6,763,811 B1 7/2004 Tamol, Sr.
6,776,352 B2 8/2004 Jameson
6,776,358 B2 8/2004 Arimoto
6,779,513 B2 8/2004 Pellizzari et al.
6,796,284 B1 9/2004 Von Wielligh
6,796,516 B2 9/2004 Maier et al.
6,799,513 B2 10/2004 Schafer
6,802,894 B2 10/2004 Brodkin et al.
6,811,103 B2 11/2004 Gurich et al.
6,814,064 B2 11/2004 Cowans
6,814,313 B2 11/2004 Petrone et al.
6,832,472 B2 12/2004 Huang et al.
6,832,588 B2 12/2004 Herden et al.
6,845,608 B2 1/2005 Klenk et al.
6,845,920 B2 1/2005 Sato et al.
6,850,069 B2 2/2005 McQueeney et al.
6,851,413 B1 2/2005 Tamol, Sr.
6,854,438 B2 2/2005 Hilger et al.
6,871,630 B2 3/2005 Herden et al.
6,883,490 B2 4/2005 Jayne
6,892,971 B2 5/2005 Rieger et al.
6,898,355 B2 5/2005 Johnson et al.
6,899,076 B2 5/2005 Funaki et al.
6,904,893 B2 6/2005 Hotta et al.
6,912,998 B1 7/2005 Rauznitz et al.
6,925,983 B2 8/2005 Herden et al.
6,935,284 B2 8/2005 Qian et al.
6,940,213 B1 9/2005 Heinz et al.
6,954,074 B2 10/2005 Zhu et al.
6,955,154 B1 10/2005 Douglas
6,955,165 B2 10/2005 Liu
6,959,693 B2 11/2005 Oda

(56) References Cited

U.S. PATENT DOCUMENTS 6,976,683 B2 12/2005 Eckert et al.
6,984,305 B2 1/2006 McAlister
6,993,960 B2 2/2006 Benson
6,994,073 B2 2/2006 Tozzi et al.
7,007,658 B1 3/2006 Cherry et al.
7,007,661 B2 3/2006 Warlick
7,013,863 B2 3/2006 Shiraishi et al.
7,025,358 B2 4/2006 Ueta et al.
7,032,845 B2 4/2006 Dantes et al.
7,070,126 B2 7/2006 Shinogle
7,073,480 B2 7/2006 Shiraishi et al.
7,077,100 B2 7/2006 Vogel et al.
7,077,108 B2 7/2006 Fujita et al.
7,077,379 B1 7/2006 Taylor
7,086,376 B2 * 8/2006 McKay ..... 123/297
7,104,246 B1 9/2006 Gagliano et al.
7,104,250 B1 9/2006 Yi et al.
7,121,253 B2 10/2006 Shiraishi et al.
7,124,718 B2 10/2006 Artola
7,131,426 B2 11/2006 Ichinose et al.
7,137,382 B2 11/2006 Zhu et al.
7,138,046 B2 11/2006 Roychowdhury
7,140,347 B2 11/2006 Suzuki et al.
7,140,353 B1 11/2006 Rauznitz et al.
7,140,562 B2 11/2006 Holzgrefe et al.
7,198,208 B2 4/2007 Dye et al.
7,201,136 B2 * 4/2007 McKay et al. ..... 123/297
7,204,133 B2 4/2007 Benson et al.
7,214,883 B2 5/2007 Leyendecker
7,228,840 B2 6/2007 Sukegawa et al.
7,249,578 B2 7/2007 Fricke et al.
7,255,290 B2 8/2007 Bright et al.
7,272,487 B2 9/2007 Christen et al.
7,275,374 B2 10/2007 Stewart et al.
7,278,392 B2 10/2007 Zillmer et al.
7,278,396 B2 10/2007 Leone et al.
7,287,492 B2 10/2007 Leone et al.
7,293,552 B2 11/2007 Leone et al.
7,302,933 B2 12/2007 Kerns
7,305,971 B2 12/2007 Fujii
7,309,029 B2 12/2007 Boecking
7,334,558 B2 2/2008 Higgins
7,340,118 B2 3/2008 Wlodarczyk et al.
7,357,101 B2 4/2008 Boyarski
7,357,108 B2 4/2008 Gracyalny
7,367,319 B2 5/2008 Kuo et al.
7,386,982 B2 6/2008 Runkle et al.
7,404,395 B2 7/2008 Yoshimoto
7,406,947 B2 8/2008 Lewis et al.
7,409,929 B2 8/2008 Miyahara et al.
7,412,966 B2 8/2008 Lewis et al.
7,418,940 B1 9/2008 Yi et al.
7,481,043 B2 1/2009 Hirata et al.
7,484,369 B2 2/2009 Myhre
7,513,222 B2 4/2009 Orlosky
7,527,041 B2 5/2009 Wing et al.
7,540,271 B2 6/2009 Stewart et al.
7,554,250 B2 6/2009 Kadotani et al.
7,574,983 B2 8/2009 Kuo
7,588,012 B2 9/2009 Gibson et al.
7,625,531 B1 12/2009 Coates et al.
7,626,315 B2 12/2009 Nagase
7,628,137 B1 12/2009 McAlister
7,650,873 B2 1/2010 Hofbauer et al.
7,703,435 B2 4/2010 Surnilla et al.
7,703,775 B2 4/2010 Matsushita et al.
7,707,832 B2 5/2010 Commaret et al.
7,714,483 B2 5/2010 Hess et al.
7,728,489 B2 6/2010 Heinz et al.
7,753,659 B2 7/2010 Boyl-Davis et al.
7,775,188 B2 8/2010 Ehrlich
7,849,833 B2 12/2010 Toyoda
7,861,696 B2 1/2011 Lund
7,880,193 B2 2/2011 Lam
7,886,993 B2 2/2011 Bachmaier et al.
7,898,258 B2 3/2011 Neuberth et al.
7,918,212 B2 4/2011 Verdejo et al.
7,938,102 B2 5/2011 Sherry
7,942,136 B2 5/2011 Lepsch et al.
8,069,836 B2 12/2011 Ehresman
8,074,625 B2 12/2011 McAlister
8,091,528 B2 1/2012 McAlister
8,147,599 B2 4/2012 McAlister
8,166,926 B2 5/2012 Sasaki et al.
8,192,852 B2 6/2012 McAlister
8,286,598 B2 10/2012 Phillips
8,297,254 B2 10/2012 McAlister
8,297,265 B2 10/2012 McAlister et al.
8,312,759 B2 11/2012 McAlister
8,322,325 B2 12/2012 Rogak et al.
8,387,599 B2 3/2013 McAlister
8,441,361 B2 5/2013 McAlister
8,479,690 B2 7/2013 Maro et al.
8,505,516 B2 8/2013 Cheiky
8,555,860 B2 10/2013 McAlister
8,561,598 B2 10/2013 McAlister
8,635,985 B2 1/2014 McAlister
8,683,988 B2 4/2014 McAlister et al.
8,733,331 B2 5/2014 McAlister
8,820,275 B2 9/2014 McAlister et al.
8,905,011 B2 12/2014 McAlister et al.
2002/0017573 A1 2/2002 Sturman
2002/0070267 A1 6/2002 Okamura et al.
2002/0084793 A1 7/2002 Hung et al.
2002/0131171 A1 9/2002 Hung
2002/0131666 A1 9/2002 Hung et al.
2002/0131673 A1 9/2002 Hung
2002/0131674 A1 9/2002 Hung
2002/0131686 A1 9/2002 Hung
2002/0131706 A1 9/2002 Hung
2002/0131756 A1 9/2002 Hung
2002/0141692 A1 10/2002 Hung
2002/0150375 A1 10/2002 Hung et al.
2002/0151113 A1 10/2002 Hung et al.
2002/0166536 A1 11/2002 Hitomi et al.
2003/0012985 A1 1/2003 McAlister
2003/0042325 A1 3/2003 D'Arrigo
2003/0127531 A1 7/2003 Hohl
2004/0008989 A1 1/2004 Hung
2004/0182359 A1 9/2004 Stewart et al.
2004/0256495 A1 12/2004 Baker et al.
2005/0045146 A1 3/2005 McKay et al.
2005/0045148 A1 3/2005 Katsuragawa et al.
2005/0081805 A1 4/2005 Novotny
2005/0098663 A1 5/2005 Ishii
2005/0255011 A1 11/2005 Greathouse et al.
2005/0257776 A1 11/2005 Bonutti
2006/0005738 A1 1/2006 Kumar
2006/0005739 A1 1/2006 Kumar
2006/0016916 A1 1/2006 Petrone et al.
2006/0037563 A1 2/2006 Raab et al.
2006/0102140 A1 5/2006 Sukegawa et al.
2006/0108452 A1 5/2006 Anzinger et al.
2006/0169244 A1 * 8/2006 Allen ..... 123/297
2007/0034175 A1 2/2007 Higgins
2007/0142204 A1 6/2007 Park et al.
2007/0189114 A1 8/2007 Reiner et al.
2007/0283927 A1 12/2007 Fukumoto et al.
2008/0072871 A1 3/2008 Vogel et al.
2008/0081120 A1 4/2008 Van Ooij et al.
2008/0098984 A1 5/2008 Sakamaki
2008/0103672 A1 5/2008 Ueda et al.
2008/0289606 A1 11/2008 Bahnev
2009/0078798 A1 3/2009 Gruendl et al.
2009/0093951 A1 4/2009 McKay et al.
2009/0145398 A1 6/2009 Kemeny
2009/0204306 A1 8/2009 Goeke et al.
2009/0223480 A1 9/2009 Sleiman et al.
2009/0264574 A1 10/2009 Van Ooij et al.
2010/0020518 A1 1/2010 Bustamante
2010/0043758 A1 2/2010 Caley
2010/0077986 A1 4/2010 Chen
2010/0077987 A1 4/2010 Voisin
2010/0174470 A1 7/2010 Bromberg et al.

(56) References Cited

U.S. PATENT DOCUMENTS

| | | | |
|---|---|---|---|
| 2010/0206249 | A1 | 8/2010 | Bromberg et al. |
| 2011/0076445 | A1 | 3/2011 | McAlister |
| 2011/0134049 | A1 | 6/2011 | Lin et al. |
| 2011/0259285 | A1 | 10/2011 | Michikawauchi et al. |
| 2011/0259290 | A1 | 10/2011 | Michikawauchi et al. |
| 2011/0265463 | A1 | 11/2011 | Kojima et al. |
| 2011/0297753 | A1 | 12/2011 | McAlister et al. |
| 2012/0037100 | A1 | 2/2012 | McAlister et al. |
| 2013/0149621 | A1 | 6/2013 | McAlister |
| 2015/0114352 | A1 | 4/2015 | McAlister et al. |

FOREIGN PATENT DOCUMENTS

| | | | |
|---|---|---|---|
| DE | 3443022 | A1 | 5/1986 |
| DE | 10315149 | A1 | 10/2004 |
| DE | 102005060139 | A1 | 6/2007 |
| DE | 102006021192 | A1 | 11/2007 |
| EP | 392594 | A2 | 10/1990 |
| EP | 671555 | A1 | 9/1995 |
| EP | 1972606 | A1 | 9/2008 |
| GB | 1038490 | A | 8/1966 |
| GB | 2226595 | A | 7/1990 |
| JP | 56-083516 | | 7/1981 |
| JP | S5683516 | A | 7/1981 |
| JP | 60-166749 | | 8/1985 |
| JP | 61-023862 | A | 2/1986 |
| JP | 02-259268 | A | 10/1990 |
| JP | 03-077665 | | 4/1991 |
| JP | 05-248281 | | 9/1993 |
| JP | 07-019142 | | 1/1995 |
| JP | 07-158532 | | 6/1995 |
| JP | 08-049623 | A | 2/1996 |
| JP | 03-115742 | B2 | 12/2000 |
| JP | 03-115743 | B2 | 12/2000 |
| JP | 02-264124 | | 9/2002 |
| JP | 2004-324613 | A | 11/2004 |
| JP | 2006-307692 | | 11/2006 |
| JP | 2007-120402 | | 5/2007 |
| JP | 08-334077 | A | 12/2008 |
| JP | 2009-281311 | | 12/2009 |
| KR | 2007-0026296 | A | 3/2007 |
| KR | 2008-0073635 | A | 8/2008 |
| RU | 2101526 | C1 | 1/1998 |
| WO | WO0165107 | A1 | 9/2001 |
| WO | WO-2008-017576 | A1 | 2/2008 |
| WO | WO2011071607 | A2 | 6/2011 |

OTHER PUBLICATIONS

"P dV's Custom Data Acquisition Systems Capabilities." PdV Consulting. Accessed: Jun. 28, 2010. Printed: May 16, 2011. <http://www.pdvconsult.com/capabilities%20-%20daqsys.html>. pp. 1-10.

"Piston motion equations." Wikipedia, the Free Encyclopedia. Published: Jul. 4, 2010. Accessed: Aug. 7, 2010. Printed: Aug. 7, 2010. <http://en.wikipedia.org/wiki/Dopant>. pp. 1-9.

"Piston Velocity and Acceleration." EPI, Inc. Accessed: Jun. 28, 2010. Printed: May 16, 2011. <http://www.epi-eng.com/piston_engine_technology/piston_velocity_and_acceleration.htm>. pp. 1-3.

"SmartPlugs—Aviation." SmartPlugs.com. Published: Sep. 2000. Accessed: May 31, 2011. <http://www.smartplugs.com/news/aeronews0900.htm>. pp. 1-3.

Birchenough, Arthur G. "A Sustained-arc Ignition System for Internal Combustion Engines." Nasa Technical Memorandum (NASA TM-73833). Lewis Research Center. Nov. 1977. pp. 1-15.

Doggett, William. "Measuring Internal Combustion Engine In-Cylinder Pressure with LabVIEW." National Instruments. Accessed: Jun. 28, 2010. Printed: May 16, 2011. <http://sine.ni.com/cs/app/doc/p/id/cs-217>. pp. 1-2.

Erjavec, Jack. "Automotive Technology: a Systems Approach, vol. 2." Thomson Delmar Learning. Clifton Park, NY. 2005. p. 845.

Hollembeak, Barry. "Automotive Fuels & Emissions." Thomson Delmar Learning. Clifton Park, NY. 2005. p. 298.

InfraTec GmbH. "Evaluation Kit for FPI Detectors | Datasheet—Detector Accessory." 2009. pp. 1-2.

International Search Report and Written Opinion for Application No. PCT/US2010/002076; Applicant: McAlister Technologies, LLC.; Date of Mailing: Apr. 29, 2011 (8 pages).

Lewis Research Center. "Fabry-Perot Fiber-Optic Temperature Sensor." NASA Tech Briefs. Published: Jan. 1, 2009. Accessed: May 16, 2011. <http://www.techbriefs.com/content/view/2114/32/>.

Riza et al. "All-Silicon Carbide Hybrid Wireless-Wired Optics Temperature Sensor Network Basic Design Engineering for Power Plant Gas Turbines." International Journal of Optomechatronics, vol. 4, Issue 1. Jan. 2010. pp. 1-9.

Riza et al. "Hybrid Wireless-Wired Optical Sensor for Extreme Temperature Measurement in Next Generation Energy Efficient Gas Turbines." Journal of Engineering for Gas Turbines and Power, vol. 132, Issue 5. May 2010. pp. 051601-1-051601-11.

International Search Report and Written Opinion for Application No. PCT/US2010/059147; Applicant: McAlister Technologies, LLC.; Date of Mailing: Aug. 31, 2011, 11 pages.

U.S. Appl. No. 13/844,240, McAlister.

U.S. Appl. No. 13/844,488, McAlister.

Bell et al. "A Super Solar Flare." NASA Science. Published: May 6, 2008. Accessed: May 17, 2011. <http://science.nasa.gov/science-news/science-at-nasa/2008/06may_carringtonflare/>. pp. 1-5.

Britt, Robert Roy. "Powerful Solar Storm Could Shut Down U.S. For Months—Science News | Science & Technology | Technology News—FOXNews.com." FoxNews.com, Published: Jan. 9, 2009. Accessed: May 17, 2011. <http://www.foxnews.com/story/0,2933,478024,00.html>. pp. 1-2.

Brooks, Michael. "Space Storm Alert: 90 Seconds from Catastrophe." NewScientist. Mar. 23, 2009. pp. 1-7.

Hodgin, Rick. "NASA Studies Solar Flare Dangers to Earth-based Technology." TG Daily. Published: Jan. 6, 2009. Accessed: May 17, 2011. <http://www.tgdaily.com/trendwatch/40830-nasa-studies-solar-flare-dangers-to-earth-based-technology>. pp. 1-2.

Pall Corporation, Pall Industrial Hydraulics. "Increase Power Output and Reduce Fugitive Emissions by Upgrading Hydrogen Seal Oil System Filtration." 2000. pp. 1-4.

Salib et al. "Role of Parallel Reformable Bonds in the Self-Healing of Cross-Linked Nanogel Particles." Langmuir, vol. 27, Issue 7. 2011. pp. 3991-4003.

International Search Report and Written Opinion for PCT Application No. PCT/US2011/024797; Applicant: McAlister Technologies, LLC; Date of Mailing: Oct. 14, 2011; 8 pages.

ISR and WO for Application PCT/US13/70710, Mail Date Dec. 24, 2013; pp. 9.

International Search Report and Written Opinion for PCT/US2014/016292 filed Feb. 13, 2014, mailed Jun. 8, 2014, 14 pages.

European Search Report for EP2918815A1, May 29, 2015, 2 pages.

* cited by examiner

INTEGRATED FUEL INJECTOR IGNITERS CONFIGURED TO INJECT MULTIPLE FUELS AND/OR COOLANTS AND ASSOCIATED METHODS OF USE AND MANUFACTURE

CROSS REFERENCE TO RELATED APPLICATIONS

This application is a continuation of U.S. application Ser. No. 12/961,461, filed Dec. 6, 2010 and titled "INTEGRATED FUEL INJECTOR IGNITERS CONFIGURED TO INJECT MULTIPLE FUELS AND/OR COOLANTS AND ASSOCIATED METHODS OF USE AND MANUFACTURE".

TECHNICAL FIELD

The following disclosure relates generally to integrated fuel injectors and igniters suitable for adaptively injecting multiple fuels and/or coolants into a combustion chamber.

BACKGROUND

Fuel injection systems are typically used to inject a fuel spray into an inlet manifold or a combustion chamber of an engine. Fuel injection systems have become the primary fuel delivery system used in automotive engines, having almost completely replaced carburetors since the late 1980s. Conventional fuel injection systems are typically connected to a pressurized fuel supply, and fuel injectors used in these fuel injection systems generally inject or otherwise release the pressurized fuel into the combustion chamber at a specific time relative to the power stroke of the engine. In many engines, and particularly in large engines, the size of the bore or port through which the fuel injector enters the combustion chamber is small. This small port accordingly limits the size of the components that can be used to actuate or otherwise inject fuel from the injector. Moreover, such engines also generally have crowded intake and exhaust valve train mechanisms, further restricting the space available for components of these fuel injection systems.

DETAILED DESCRIPTION

Figure 1A:
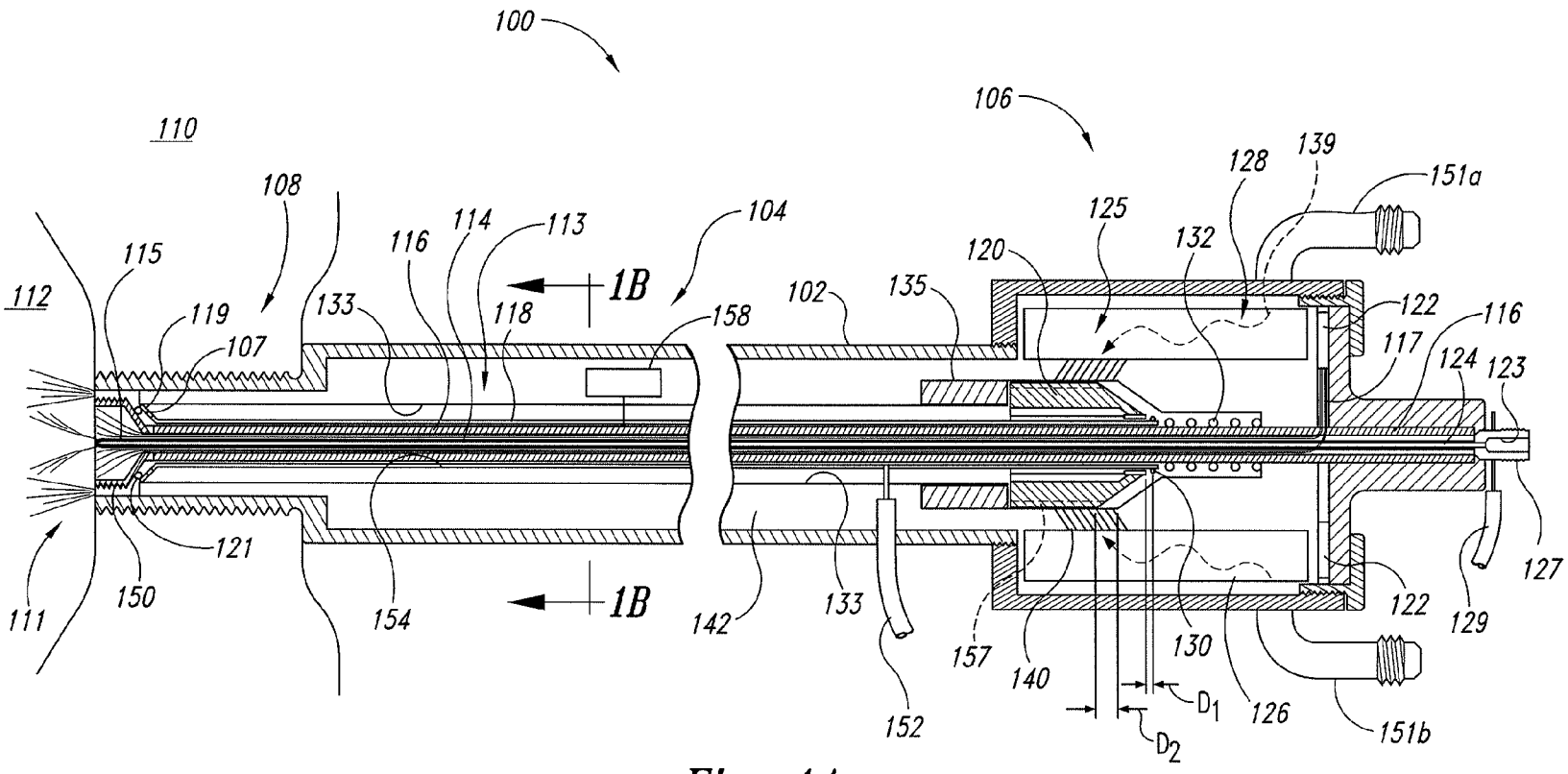
FIG. 1A is a cross-sectional side view of an integrated injector igniter configured in accordance with an embodiment of the disclosure.

The present application incorporates by reference in its entirety the subject matter of U.S. patent application Ser. No. 12/961,453, filed Dec. 6, 2010, now U.S. Pat. No. 8,091,528, and titled "INTEGRATED FUEL INJECTOR IGNITERS HAVING FORCE GENERATING ASSEMBLIES FOR INJECTING AND IGNITING FUEL AND ASSOCIATED METHODS OF USE AND MANUFACTURE".

The present disclosure describes integrated fuel injection and ignition devices for use with internal combustion engines, as well as associated systems, assemblies, components, and methods regarding the same. For example, several of the embodiments described below are directed generally to adaptable fuel injectors/igniters that can inject two or more fuels, coolants, or combinations of fuels and coolants into a combustion chamber during operation. As used herein, the term coolant can include any fluid (e.g., gas or liquid) that produces cooling. In one embodiment, for example, a coolant can include non-combusting fluid. In other embodiments, however, a coolant can include a fuel that ignites and/or combusts at a lower temperature than another fuel. In certain other embodiments a fluid (e.g., a coolant) provides cooling of substances such as air or components of a combustion chamber. Certain details are set forth in the following description and in FIGS. 1A-3D to provide a thorough understanding of various embodiments of the disclosure. However, other details describing well-known structures and systems often associated with internal combustion engines, injectors, igniters, and/or other aspects of combustion systems are not set forth below to avoid unnecessarily obscuring the description of various embodiments of the disclosure. Thus, it will be appreciated that several of the details set forth below are provided to describe the following embodiments in a manner sufficient to enable a person skilled in the relevant art to make and use the disclosed embodiments. Several of the details and advantages described below, however, may not be necessary to practice certain embodiments of the disclosure.

Many of the details, dimensions, angles, shapes, and other features shown in the Figures are merely illustrative of particular embodiments of the disclosure. Accordingly, other embodiments can have other details, dimensions, angles, and features without departing from the spirit or scope of the present disclosure. In addition, those of ordinary skill in the art will appreciate that further embodiments of the disclosure can be practiced without several of the details described below.

Reference throughout this specification to "one embodiment" or "an embodiment" means that a particular feature, structure, or characteristic described in connection with the embodiment is included in at least one embodiment of the present disclosure. Thus, the occurrences of the phrases "in one embodiment" or "in an embodiment" in various places throughout this specification are not necessarily all referring to the same embodiment. Furthermore, the particular features, structures, or characteristics described with reference to a particular embodiment may be combined in any suitable manner in one or more other embodiments. Moreover, the headings provided herein are for convenience only and do not interpret the scope or meaning of the claimed disclosure.

FIG. 1A is a cross-sectional side view of an integrated injector/igniter 100 ("injector 100") configured in accordance with an embodiment of the disclosure. The injector 100 includes a body 102 having a middle portion 104 extending between a first end portion or base portion 106 and a second end portion of a nozzle portion 108. The nozzle portion 108 is configured to at least partially extend through an engine head 110 to inject and ignite fuel at or near an interface 111 of a combustion chamber 112. As described in detail below, the injector 100 is particularly suited to provide adaptive and rapid actuation of two or more fuels, coolants, or combinations of fuels and coolants.

In the embodiment shown in FIG. 1A, the injector 100 includes a core assembly 113 extending from the base portion 106 to the nozzle portion 108. The injector 100 also includes a body insulator 142 coaxially disposed over at least a portion of the core assembly 113. The core assembly 113 includes an ignition conduit, rod, or conductor 114, an ignition insulator 116, and a valve 118. The ignition insulator 116 is coaxially disposed over at least a portion of the ignition conductor 114 and extends from the base portion 106 to the nozzle portion 108. As described in detail below, the valve 118 is coaxially disposed over at least a portion of the ignition insulator and moves longitudinally through the body 102. For example, the valve 118 is an inwardly opening valve (e.g., opening in a direction away from the combustion chamber) and is movable relative to the core insulator 114 to selectively introduce fuel from the nozzle portion 108 into the combustion chamber 112. More specifically, the valve 118 is configured to slide or otherwise move relative to the core insulator 116 in directions that are generally parallel to a longitudinal axis of the injector 100. The valve 118 includes a first end portion in the base portion 106 that engages a valve operator assembly 125. The valve 118 also includes a second or sealing end portion 119 that engages or otherwise contacts a valve seal 121 in the nozzle portion 108 carried by the second ignition feature 150. The sealing end portion 119 also includes an exit opening 107 positioned radially inwardly from the valve seal 121. As described in detail below, the exit opening 107 allows a fuel or coolant to pass from a second flow passage 133 to be adjacent to the valve seal 121, and when the sealing end portion 119 spaces apart from the valve seal 121, the fuel or coolant can exit the nozzle portion 108. The sealing end portion 119 and/or the valve seal 121 can include one or more elastomeric portions. As described in detail below, the valve operator assembly 125 actuates the valve 118 relative to the ignition insulator 116 between an open position and a closed position (as shown in FIG. 1A). In the open position, the sealing end portion 119 of the valve 118 is spaced apart from the valve seal 121 to allow fuel or coolant to flow past the valve seal 121 and out of the nozzle portion 108 to produce distribution pattern 160 as shown in FIG. 1A.

In certain embodiments, the valve 118 can be made from reinforced structural composites as disclosed in U.S. patent application Ser. No. 12/857,461, filed Aug. 16, 2010, and titled "INTERNALLY REINFORCED STRUCTURAL COMPOSITES AND ASSOCIATED METHODS OF MANUFACTURING," which is incorporated herein by reference in its entirety. For example the valve 118 can be made from relatively low density spaced graphite or graphene structures that provide the benefits of reducing inertia, achieving high strength and stiffness, and providing high fatigue endurance strength. More specifically, the valve 118 can be constructed from a light weight but strong graphite structural core that is reinforced by one or more carbon-carbon layers. The carbon-carbon layer(s) may be prepared from a suitable precursor application of carbon donor (e.g., petroleum pitch or a thermoplastic such as a polyolefin or PAN). The one or more carbon-carbon layers can further provide radio frequency shielding and protection. Additional protection may be established by plating the outer surface of the valve 118 with a suitable alloy, such as a nickel alloy that may be brazed to the valve 118 by a suitable braze alloy composition.

The ignition conductor 114 includes an end portion 115 proximate to the interface 111 of the combustion chamber 112 that includes one or more ignition features that are configured to generate an ignition event. The ignition conductor 114 also includes a first flow passage or channel 124 extending longitudinally through a central portion of the ignition conductor 114. The ignition conductor 114 is operably coupled to a first terminal 127 at the base portion 106. The first terminal 127 is configured to supply ignition energy (e.g., voltage), as well as a first fuel or first coolant, to the ignition conductor 114. More specifically, the first terminal 127 includes a first inlet passage 123 that is fluidly coupled to the first flow channel 124. The first terminal 127 is also configured to be coupled to a first fuel or coolant source, as described in detail below, to introduce the first fuel or coolant into the first flow channel 124 via the first inlet passage 123. The ignition conductor 114 therefore dispenses the first fuel or coolant into the combustion chamber 112 via the first flow channel 124. The first terminal 127 is also coupled to a first ignition energy source via a first ignition source conductor 129. The first ignition source conductor 129 accordingly provides first ignition energy to the ignition conductor 114 via the first terminal 127. The ignition conductor 114 can therefore ignite the first fuel at the nozzle portion 108 with the first ignition energy. In one embodiment, for example, the first terminal 127 can supply at least approximately 80 KV (DC or AC) to the ignition conductor 114. In other embodiments, however, the first terminal 127 can supply a greater or lesser voltage to the ignition conductor 114.

According to features of the illustrated embodiment, the first flow channel or passage 124 is electrically isolated or insulated from the second flow channel or passage 133. This electrical isolation allows for different ignition energies to be applied to the different fuels that flow through these passages. Moreover, and as described in detail below, the second flow passage 133 can include multiple discrete or fluidly separated channels or passages (see, e.g., FIGS. 1C and 1D). As such, different fuels and/or coolants can be separately transmitted through the second flow passage 133, in addition to different fuels and/or coolants that pass through the first flow channel or passage 124. More specifically, in one embodiment, a first fuel or first coolant can flow through the first flow passage 124, a second fuel or second coolant can flow through a first discrete channel in the second flow passage 133, and a third fuel or third coolant can flow through a second discrete channel in the second flow passage 133. In still further embodiments, more than three fuels or three coolants can flow through the various flow channels.

The injector 100 further includes an insulated second terminal 152 at the middle portion 104 or at the base portion 106. The second terminal 152 is electrically coupled to the second ignition feature 150 via a second ignition conductor 154. For example, the second ignition conductor 154 can be a conductive layer or coating disposed on the ignition insulator 116. The second ignition conductor 154 accordingly transmits the ignition energy (e.g., voltage) to the second ignition feature 150 at the nozzle portion 108. As shown in the illustrated embodiment, the second ignition feature 150 is coaxial and radially spaced apart from the end portion 115 of the ignition conductor 114. Moreover, in the illustrated embodiment, the second ignition features 150 can include a plurality of threads or acicular protrusions extending circumferentially around and spaced apart from the end portion 115 of the ignition conductor 114. In other embodiments, however, the second terminal 152 can be omitted and ignition energy can be supplied to the second ignition feature from a force generator assembly carried by the base portion 106.

The injector 100 further includes an energy storage provision such as capacitor 158 carried by the body 102. In the illustrated embodiment, the capacitor 158 is positioned in the body insulator 142 at the middle portion 104. In other embodiments, however, the capacitor 158 can be positioned at other locations, including for example, at or near the nozzle portion 108. The capacitor 158 is configured to provide ignition energy to ignite one or more fuels. For example, the capacitor 158 is coupled to the second ignition conductor 154.

The capacitor can be charged by energy harvested from the combustion chamber 112 or from another suitable source. For example, the capacitor can be charged with and store ignition energy from photovoltaic, thermoelectric, acoustical, and/or pressure energy harvested from the combustion chamber 112.

According to features of the illustrated embodiment, the injector 100 is configured to provide different amounts or values of ignition energy as needed to ignite the corresponding fuels or coolants. For example, in one embodiment the first terminal 129 can provide a greater ignition energy than ignition energy from the second terminal 152, induced ignition energy in the force generator assembly 128, and/or stored ignition energy from the capacitor 158 for the purpose of initiating ignition of fuels that are relatively difficult to ignite. In other embodiments, however, these additional ignition energy sources can provide the greater ignition energy. Moreover, any of these ignition energy sources can be used for the purpose of sustaining the ignition event.

According to additional features of the illustrated embodiment, the injector 100 also includes a second flow passage or channel 133. In the illustrated embodiment, the second flow channel 133 extends longitudinally through the body 102 from the base portion 106 to the nozzle portion 108. More specifically, the second flow channel 133 extends coaxially with the stem portion of the valve 118 and is spaced radially apart from the stem portion of the valve 118. As explained in detail below, a second fuel or coolant can enter the second flow channel 133 from the base portion 106 of the injector 100 to pass to the combustion chamber 112. As also explained in detail below, the second flow channel 133 can include multiple discrete sub-channels or passages that are fluidly separated from one another, and that are coupled to corresponding individual fuel inlet passages 151 (identified individually as a first inlet passage 151*a* and a second inlet passage 151*b*). As such, multiple different second fuels and/or second coolants can travel through the corresponding sub-channels of the second flow passage 133.

The injector 100 can also include one or more sensors that are configured to detect properties or conditions in the combustion chamber 112. For example, in the illustrated embodiment injector 100 includes sensors or fiber optic cables 117 extending longitudinally through the body 102 from the base portion 106 to the nozzle portion 108. The fiber optic cables 117 can be coupled to or otherwise extend along with the ignition conductor 114. Moreover, the fiber optic cables 117 can be coupled to one or more controllers or processors 122 carried by the body 102. In the illustrated embodiment, the fiber optic cables 117 expand or otherwise fan radially outwardly at the nozzle portion 108 in the space between the ignition conductor 114 and the second ignition features 150. The expanded end portion of the fiber optic and/or other sensor cables 117 provides an increased area for the fiber optic cables 117 to gather information at the interface with the combustion chamber 112.

In addition to the valve operator assembly 125, the injector 100 also includes a force generator assembly 128 carried by the base portion 106. The valve operator assembly 125 is operably coupled to the valve 118 and configured to move the valve 118 between the open and closed positions in response to the force generator assembly 128. For example, the valve operator assembly 125 moves the valve 118 longitudinally in the injector 100 relative to the ignition insulator 116. The valve operator assembly 125 includes at least an actuator or driver 120 that is coupled to the valve 118. The force generator assembly 128 includes a force generator 126 (e.g., an electric, electromagnetic, magnetic, etc. force generator) that induces movement of the driver 120.

In certain embodiments, for example, the force generator 126 can be a solenoid that induces a magnetic field to move a ferromagnetic driver 120. In still further embodiments, the force generator assembly 128 can include two or more solenoid windings acting as a transformer for the purpose of inducing movement of the driver 120 and generating ignition energy. More specifically, a force generator assembly 128 having two or more force generators 126 can be configured to control fuel flow by opening any of the valve assemblies, and to produce of ionizing voltage upon completion of the valve opening function. To achieve both of these functions, in certain embodiments, for example, each force generator assembly 128 can be a solenoid winding including a first or primary winding and a secondary winding. The secondary winding can include more turns than the first winding. Each winding can also include one or more layers of insulation (e.g., varnish or other suitable insulators), however the secondary winding may include more insulating layers than the first winding. By configuring a force generator 126 as a transformer with a primary winding and a secondary winding of many more turns, the primary winding can carry high current upon application of voltage to produce pull or otherwise induce movement of the driver 120. Upon opening the relay to the primary winding, the driver 120 is released and a very high voltage will be produced by the secondary winding. The high voltage of the secondary winding can be applied to the plasma generation ignition event by providing the initial ionization, after which relatively lower voltage discharge of a capacitor that has been charged with any suitable source (including energy harvested from the combustion chamber 112 by photovoltaic, thermoelectric, and piezoelectric generators) and/or continue to supply ionizing current and thrust of fuel into the combustion chamber. Suitable force generating assemblies 128 are described in U.S. patent application Ser. No. 12/961,453, filed Dec. 6, 2010, now U.S. Pat. No. 8,091,528, titled "INTEGRATED FUEL INJECTOR IGNITERS HAVING FORCE GENERATING ASSEMBLIES FOR INJECTING AND IGNITING FUEL AND ASSOCIATED METHODS OF USE AND MANUFACTURE" and incorporated by reference in its entirety. In embodiments where the force generator assembly 128 includes two or more solenoid windings to induce movement of the driver 120 and generate ignition energy for the second ignition feature 150, the second terminal 152 can be omitted from the injector 100.

The force generator 128 can also be operably coupled to the processor or controller 122, which can in turn also be coupled to the one or more fiber optic cables 117 extending through the ignition conductor 114. As such, the controller 122 can selectively energize or otherwise activate the force generator 126, for example, in response to one or more combustion chamber conditions or engine parameters. When the force generator 126 actuates the driver 120, the driver 120 engages one or more stops 130 integrally formed with or otherwise attached to the first end portion of the valve 118 to move the valve 118 between the open and closed positions. The valve operator assembly 125 can also include a first biasing member 132 that contacts the valve 118 and at least partially urges the valve 118 to the closed position in a direction toward the nozzle portion 108. The valve operator assembly 125 can further include a second biasing member 135 that at least partially urges the driver 120 toward the nozzle portion 108. In certain embodiments, the first biasing member 132 can be a spring, such as a coil spring, and the second biasing member 135 can be a magnet or a permanent magnet. In other embodiments, however, the first biasing member 132 and the second biasing member 135 can include other components suitable for providing a biasing force against the valve 118 and the driver 120. Embodiments including a magnet or permanent magnet for the second biasing member can provide for relatively fast or quick actuation while inducing or avoiding potential resonance associated with coil springs.

In operation, the injector 100 is configured to inject two or more fuels, coolants, and/or combinations of fuels and coolants into the combustion chamber 112. The injector 100 is also configured to ignite the fuels as the fuels exit the nozzle portion 108 into the combustion chamber. For example, a first fuel or coolant can be introduced into the first flow passage 124 in the ignition conductor 116 via the first inlet passage 123 in the first terminal 127. Precise amounts of fuel and/or coolant can be metered from a pressurized fuel source from a valve assembly as described in detail below. The first fuel or coolant travels through the injector 100 from the base portion 106 to the nozzle portion 108. In instances where the nozzle portion 108 dispenses metered amounts of a pressurized first fuel, the first ignition source conductor 129 can energize or otherwise transmit ignition energy (e.g., voltage) to an ignition feature carried by the ignition conductor 116 at the nozzle portion 108. As such, the ignition conductor 116 can ignite the first fuel at the interface 111 with the combustion chamber 112.

A second fuel or coolant can be introduced into the base portion 106 via the force generator assembly 128. For example, a second fuel or coolant can enter the force generator assembly 128 via the second inlet passage 151*b*. The second fuel or coolant can travel from the second inlet passage 151 through the force generator 128 as indicated by base portion flow paths 139. The second fuel or coolant exits the force generator 128 through multiple exit channels 140 and then passes through passages 157 in the driver 120 to reach the second flow channel 133 extending longitudinally adjacent to the valve 118. As noted above, the second flow channel 133 extends between an outer surface of the valve 118 and an inner surface of the body insulator 142 of the middle portion 104 and the nozzle portion 108. The body insulator 142 can be made from a ceramic or polymer insulator suitable for containing the high voltage developed in the injector 100, as disclosed in the patent applications incorporated by reference in their entireties above.

The valve operator assembly 125 and the force generator assembly 128 work in combination to precisely and/or adaptively meter or dispense the second fuel or coolant into the second flow channel 133 and past the sealing head 119 of the valve 118. For example, the force generator 126 induces movement of the driver 120 to move the valve 118 longitudinally along the core insulator 116 to space the sealing end portion 119 of the valve 118 away from the valve seal 121. More specifically, when the force generator 126 induces the movement of the driver 120, the driver 120 moves a first distance $D_1$ prior to contacting the stop 130 carried by the valve 118. As such, the driver 120 can gain momentum or kinetic energy before engaging the valve 118. After the driver 120 contacts the stop 130, the driver 120 continues to move to a second or total distance $D_2$ while engaging the valve 118 to exert a tensile force on the valve 118 and move the valve 118 to the open position. As such, when the valve 118 is in the open position, the sealing head 119 of the valve 118 is spaced apart from the valve seal 121 by an open distance generally equal to the second or total distance $D_2$ minus the first distance $D_1$. As the valve 118 moves between the open and closed positions in directions generally parallel with a longitudinal axis of the injector 100, the ignition conductor 114 and the insulator 116 remain stationary within the body 102. The insulator 116 therefore acts as a central journal bearing for the valve 118 and can accordingly have a low friction outer surface that contacts the valve 118. Moreover, and as discussed in detail below, the second ignition feature 150 can create an ignition event to ignite the second fuel before or as the second fuel enters the combustion chamber 112.

As the second fuel flows toward the combustion chamber 112 through the second flow channel 133, the second ignition conductor 150 conveys DC and/or AC voltage to adequately heat and/or ionize and rapidly propagate and thrust the fuel toward the combustion chamber. In certain embodiments, the force generator assembly 128 can provide the ignition energy to the second ignition feature 150 via the second ignition conductor 154. For example, in embodiments where the force generator assembly 128 includes a primary solenoid winding or piezoelectric component that induces movement of the driver 120 and also induces voltage in a secondary solenoid winding, the secondary solenoid winding can provide the ignition energy to the second ignition feature. In other embodiments, however, the second terminal 152 can provide the ignition energy to the second ignition feature 150 via the second ignition conductor 154.

With respect to the first ignition features at the end portion 115 of the ignition conductor 114, as well as the second ignition feature 150, each ignition feature can develop plasma discharge blasts of ionized fuel that is rapidly accelerated and injected into the combustion chamber 112. Generating such high voltage at the ignition features initiates ionization, which is then rapidly propagated as a much larger population of ions in plasma that develops and travels outwardly to thrust fuel past the interface 111 into the combustion chamber 112 into surplus air to provide insulation of more or less adiabatic stratified chamber combustion. As such, the injector 100 is capable of ionizing air within the nozzle portion 108 prior to introducing fuel into the ionized air, ionizing fuel combined with air, as well as layers of ionized air without fuel and ionized fuel and air combinations, as disclosed in the patent applications incorporated by reference in their entireties above.

In one mode of operation, delivery of a rapid combustant such as hydrogen or hydrogen-characterized fuel mixture is made through inlet port 151 and past valve seal 119 to be ignited with relatively low ignition energy by electrode 150. Such rapid combustion as depicted by distribution pattern 160 thereby rapidly heats and forces rapid evaporation, cracking and completion of combustion of other fuels such as liquid diesel fuel that can be delivered through the second inlet port 123 and through conduit 124 to produce a second distribution pattern 162. The second distribution pattern 162 can be different than the first distribution pattern 160. This mode of rapid-combustant characterized operation enables other commensurately delivered fuels with relatively difficult ignition characteristics and/or tendencies to produce unburned hydrocarbon and/or particulate emissions including diesel and bunker fuels to be readily combusted without such emissions including applications in engines with insufficient compression ratios, fuel pressure, or operating temperature to provide satisfactory compression ignition.

In another mode of operation, fuel selections such as diesel and bunker fuels that normally produce such objectionable emissions are delivered through the second inlet 123 to conduit 124 for injection that is characterized by ionization by heat and/or plasma formation as a result of sufficiently greater ignition energy delivery through electrical lead 129 to force rapid evaporation, cracking and completion of combustion without such emissions. Application of such ignition energy enables clean utilization of fuels with insufficient cetane ratings for compression ignition and applications in engines with insufficient compression ratios, fuel pressure, or operating temperature to provide satisfactory compression ignition.

Figure 1B:
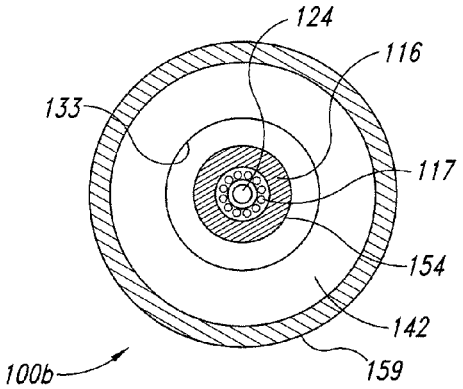
FIGS. 1B-1D are a series of cross-sectional end views of the injector of FIG. 1A taken substantially along lines 1B-1B in FIG. 1A.

FIG. 1B is a cross-sectional end view of an embodiment of a second injector 100*b* taken substantially along lines 1B-1B in FIG. 1A. More specifically, the embodiment shown in FIG. 1A illustrates the concentric or coaxial arrangement of several of the components of the injector 100. However, for clarity the tubular cross section of valve 118 is not illustrated in FIG. 1B. In the illustrated embodiment, the second injector 100*b* includes a casing 159, such as a metallic or steel casing disposed over the body insulator 142. The second flow channel 133 is positioned radially outwardly from the valve and second ignition conductor 154, and the ignition insulator 116 is positioned radially inwardly from the valve and second ignition conductor 154. The fiber optic cables 117 are adjacent to the ignition conductor, and the first flow channel 124 extends through the ignition conductor. In the illustrated embodiment, the second flow channel 133 has a generally circular cross-sectional shape. In other embodiments, and as described below, the second flow channel 133 can include shapes other than circular and/or includes multiple sub-channels or discrete separated sub-portions for flowing various different fuels and/or coolants.

Figure 1C:
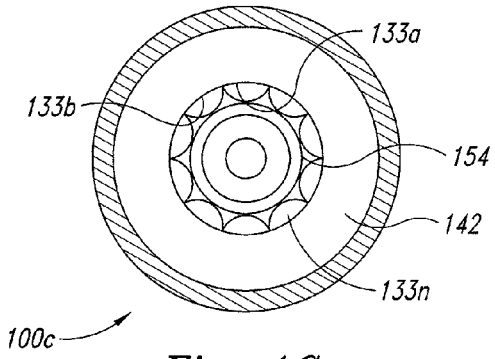
Figure 1D:
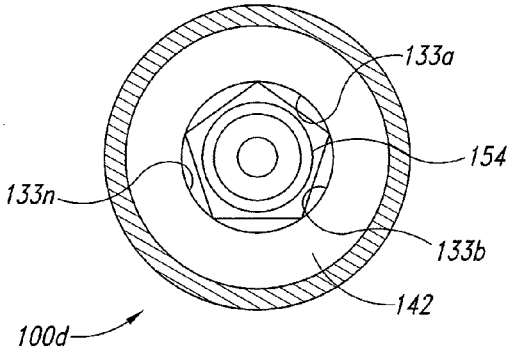

FIG. 1C is a cross-sectional end view of a third injector 100*c* taken substantially along lines 1B-1B in FIG. 1A. The embodiment of the third injector 100*c* shown in FIG. 1C illustrates several second flow sub-channels 133 (identified individually as first through nth sub-channels 133*a*-133*n*) between the body insulator 142 and the combination of the second ignition conductor 154 and second valve 118 (for clarity, the tubular cross-section of valve 118 is not illustrated in FIG. 1C). Although the illustrated embodiment includes second flow sub-channels 133 forming a star or gear shaped pattern, in other embodiments these flow channels can have other configurations. For example, FIG. 1D illustrates an additional embodiment of a fourth injector 100*d* having multiple discrete or separate second flow sub-channels 133 (identified individually as first through nth sub-channels 133*a*-133*n*) forming a generally pentagonal shape (for clarity, the tubular cross section of valve 118 is not illustrated in FIG. 1D). In other embodiments, however, the second flow sub-channels 133 can be arranged in other shapes or configurations.

Figure 2A:
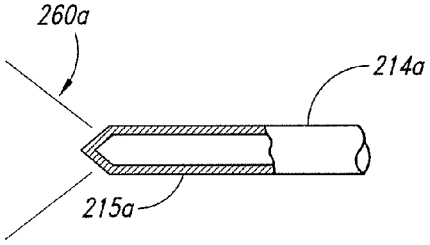
FIGS. 2A-2D are a series of cross-sectional side views of nozzle portions of injectors configured in accordance with embodiments of the disclosure.

FIGS. 2A-2D are a series of cross-sectional side views of nozzle portions 214 of injectors configured in accordance with embodiments of the disclosure. The embodiments illustrated in FIGS. 2A-2D are configured to provide various spray patterns or distributions of fuels and/or coolants. For example, these embodiments provide examples of spray or distribution patterns that can be used to optimize combustion chamber conditions, such as temperature, pressure, completion of the combustion event, etc. In FIG. 2A, for example, a first nozzle portion 214*a* includes a first end portion 215*a* that dispenses or disperses a first injection or distribution pattern 260*a* into a combustion chamber. More specifically, the first end portion 215*a* can have one or more openings that create the first distribution pattern 260*a*. The first distribution pattern 260*a* can have a generally uniform expanding shape (e.g., cone-shaped). In certain embodiments, the first injection pattern 260*a* is suitable for a symmetrical combustion chamber.

Figure 2B:
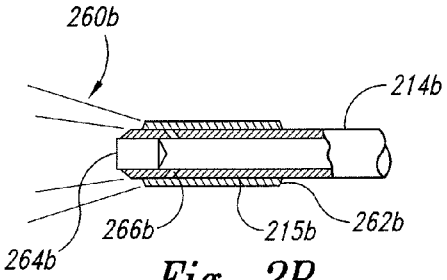

In FIG. 2B, a second nozzle portion 214*b* includes a radially expanding second sleeve valve 262*b* covering at least a portion of a second end portion 215*b*. The second sleeve valve 262*b* is configured to open, expand, slide, or otherwise actuate in response to pressurized fuel and/or in response to one or more actuating devices. In one embodiment, the second sleeve valve 262*b* at least partially covers one or more second exit openings 266*b* in the second end portion 215*b*. The second nozzle portion 214*b* also includes a second end stop or plug 264*b* at least partially blocking the flow of fuel or coolant out of the second end portion 215*b*. As such, the second exit openings 266*b* are configured to allow the fuel or coolant to exit the second end portion 215*b* in a second injection or distribution pattern 260*b*. The second distribution pattern 260*b* accordingly includes a central void generally surrounded by a radially expanding cone shape of injected fuel and/or coolant.

Figure 2C:
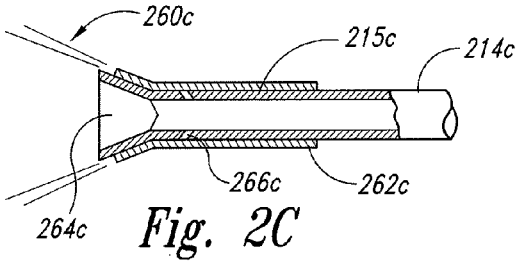

In FIG. 2C, a third nozzle portion 214*c* includes a radially expanding sleeve valve 262*c* covering at least a portion of a third end portion 215*c*. The third sleeve valve 262*c* is configured to open, slide, or otherwise expand or actuate in response to pressurized fuel and/or in response to one or more actuating devices. The third sleeve valve 262*c* at least partially covers one or more third exit openings 266*c* in the third end portion 215*c*. The third nozzle portion 214*c* also includes a third end stop or plug 264*c* at least partially blocking the flow of fuel or coolant out of the third end portion 215*c*. In the illustrated embodiment, however, the third plug 264*c* has a generally conical shape that is inserted into an expanded section of the third end portion 215*c*. As such, the third exit openings 266*c* are configured to allow the fuel or coolant to exit the third end portion 215*c* in a third injection or distribution pattern 260*c*. The third distribution pattern 260*c* accordingly includes a conically-shaped radially expanding central void generally surrounded by a corresponding radially expanding cone shape of injected fuel and/or coolant.

Figure 2D:
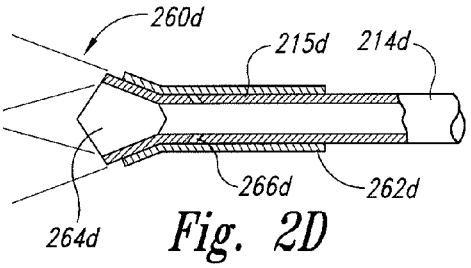

In FIG. 2D, a fourth nozzle portion 214*d* includes a radially expanding sleeve valve 262*d* covering at least a portion of a fourth end portion 215*d*. The fourth sleeve valve 262*d* is configured to open, slide, or otherwise expand or actuate in response to pressurized fuel and/or in response to one or more actuating devices. The fourth sleeve valve 262*d* at least partially covers one or more fourth exit openings 266*d* in the fourth end portion 215*d*. The fourth nozzle portion 214*d* also includes a fourth end stop or plug 264*d* at least partially blocking the flow of fuel or coolant out of the fourth end portion 215*d*. In the illustrated embodiment, however, the fourth plug 264*d* has a generally conical shape that is inserted into an expanded section of the fourth end portion 215*d*. As such, the fourth exit openings 266*d* are configured to allow the fuel or coolant to exit the fourth end portion 215*d* in a fourth injection or distribution pattern 260*d*. The fourth distribution pattern 260*d* accordingly includes a converging central void generally surrounded by a corresponding radially expanding cone shape of injected fuel and/or coolant.

The embodiments described above with reference to FIGS. 2A-2D can accordingly provide various fuel and/or coolant distribution patterns (e.g., focused patterns, evenly distributed patterns, etc.) suitable for various ignition and cooling needs. One of ordinary skill in the art will appreciate, however, that the embodiments described above with reference to FIGS. 2A-2D are not exhaustive of all of the different configurations for various fuel distribution patterns. For example, the size, shape, orientation, and/or distribution of the exit openings 266 in the corresponding second end portions 215 can provide desired distribution patterns. In certain embodiments, a single nozzle portion 214 can include exit openings 266 having different sizes, shapes, and/or orientations. Moreover, these individual exit openings 266 can provide an outlet for corresponding individual flow channels or passages. Accordingly, a first fuel or first coolant can be dispensed through a first flow channel and corresponding exit opening 266 to provide a first distribution or spray pattern in the combustion chamber. In addition, a second fuel or second coolant can be dispensed through a second flow channel and corresponding exit opening 266 to provide a second distribution or spray pattern in the combustion chamber that is different from the first distribution pattern. Additional fuels and/or coolants can be dispensed through corresponding additional flow channels and exit openings.

Figure 3A:
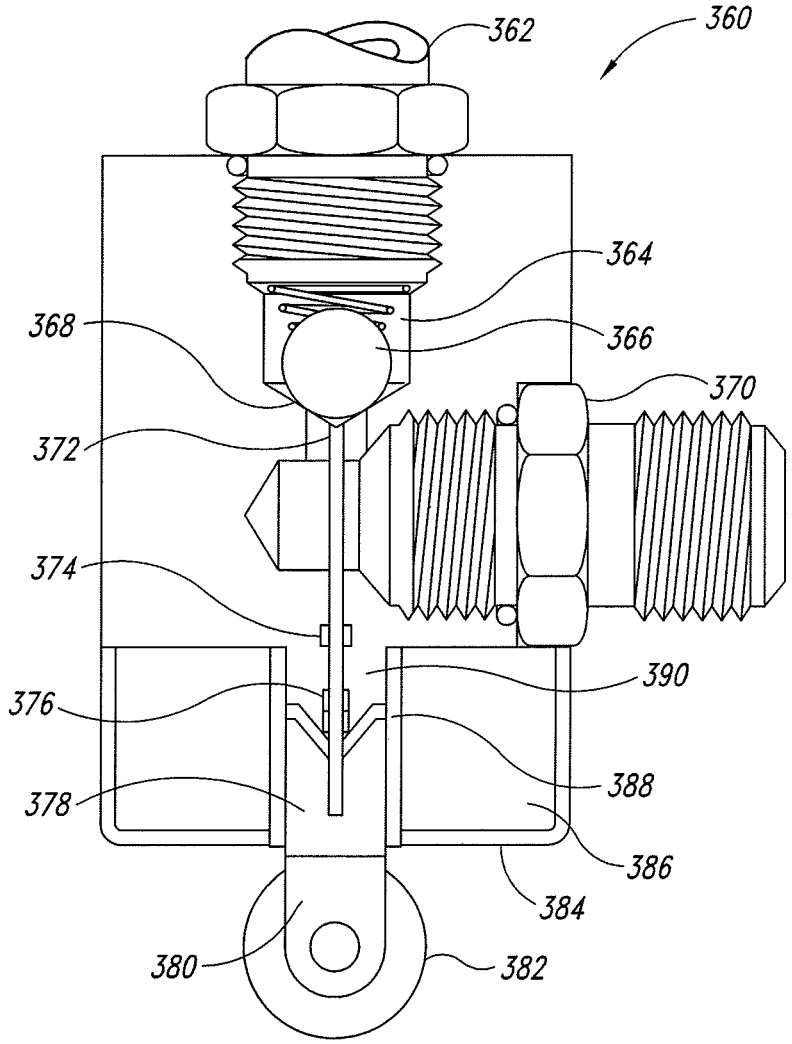
FIG. 3A is a cross-sectional side view of a valve distribution subassembly.

FIG. 3A is a cross-sectional side view of a valve distribution subassembly 360 ("subassembly 360") that can be operably coupled to the first terminal 127 to deliver a first fuel or a first coolant to the injector 100 (as shown in FIG. 1A) from a pressurized fuel source. The subassembly 360 reliably enables control of the delivery of pressurized supplies of various fuels and/or coolants. According to aspects of this disclosure, the subassembly 360 is particularly beneficial for enabling various fuels including very low energy density fuels to be utilized in large engines in conjunction with an injector as described herein. The subassembly 360 also enables such fuels or coolants to be partially utilized to greatly improve the volumetric efficiency of converted engines by increasing the amount of air that is induced into the combustion chamber during each intake cycle. Although the subassembly 360 is described below in operation with reference to a fuel, in other application embodiments the subassembly 360 can dispense various coolants.

In operation, pressurized fluid such as a fuel is supplied through inlet fitting 362 to the valve chamber shown where a biasing member 364 (e.g., coil spring) urges a valve 366 (e.g., ball valve) toward a closed position on a valve seat 368 as shown in FIG. 3A. In high-speed engine applications, or where spring 364 is objectionable because solids in slush fuels tend to build up, it may be preferred to provide valve seat 368 as a pole of a permanent magnet to assist in rapid closure of the ball valve 366. When fuel delivery to a combustion chamber is desired, an actuator or push-rod 372 forces the ball valve 366 to lift off of the valve seat 368 to permit fuel to flow around the ball valve 366 and through the passageway to fitting 370 for delivery to the combustion chamber, such as through the first terminal 127 of the injector 100 (FIG. 1A). In certain embodiments, the push rod 372 can be sealed by closely fitting within a bore 390, or by an elastomeric seal such as an O-ring 374. The actuation of push rod 372 can be by any suitable method or combination of methods.

According to one embodiment, suitable control of fuel or coolant flow can be provided by solenoid action resulting from the passage of an electrical current through an annular winding 386 within a steel cap 384 in which a solenoid plunger 378 moves axially with connection to the push rod 372, as shown. In certain embodiments the plunger 378 can be made from a ferromagnetic material that is magnetically soft. Moreover, the plunger 378 can be guided in linear motion by a sleeve bearing 388, which can be a self-lubricating polymer, or low friction alloy, such as a Nitronic alloy, or a permanently lubricated powder-metallurgy oil-impregnated bearing that is threaded, engaged with an interference fit, locked in place with a suitable adhesive, swaged, or braised to be permanently located on the ferromagnetic pole piece 390.

In other embodiments, the ball valve 366 may also be opened by an impulse action in which the plunger 378 is allowed to gain considerable momentum before providing considerably higher opening force after it is allowed to move freely prior to suddenly causing actuator pin 372 to strike the ball valve 366. In this embodiment, it may be preferred to provide sufficient "at rest" clearance between the ball valve 366 and the end of the push rod 372 when the plunger 378 is in the neutral position at the start of acceleration towards the ball valve 366 to thereby allow considerable momentum to be developed before the push rod 372 suddenly impacts the ball valve 366.

As an alternative method for intermittent operation of the push rod 372 and the ball valve 366 can be with a rotary solenoid or mechanically driven cam displacement that operates at the same frequency that controls the air inlet valve(s) and/or the power stroke of the engine. Such mechanical actuation can be utilized as the sole source of displacement for ball valve 366 or in conjunction with a push-pull or rotary solenoid. In operation, for example, a clevis 380 holds a ball bearing assembly 382 in which a roller or the outer race of an antifriction bearing assembly rotates against or over a suitable cam to cause linear motion of the plunger 378 and the push rod 372 toward the ball valve 366. After striking the ball valve 366 for development of fuel flow as desired, the ball valve 366 and plunger 378 are returned to the neutral position by the magnetic seat 364 and/or a biasing member 376 (e.g., coil spring).

It is similarly contemplated that suitable operation of unit valve 360 may be by cam displacement of 382 with "hold-open" functions by a piezoelectric operated brake (not shown) or by actuation of electromagnet 386 that is applied to plunger 378 to continue the fuel or coolant flow period after passage of the cam lobe against 382. This provides fluid flow valve functions in which a moveable valve element such as 366 is displaced by plunger 372 that is forced by suitable mechanisms including a solenoid, a cam operator, and a combination of solenoid and cam operators in which the valve element 366 is occasionally held in position for allowing fluid flow by such solenoid, a piezoelectric brake, and/or a combination of solenoid and piezoelectric mechanisms.

Fuel and/or coolant flow from unit valve 360 may be delivered to the engine's intake valve port, to a suitable direct cylinder fuel injector, and/or delivered to an injector having selected combinations of the embodiments described herein. In some applications such as large displacement engines it is desirable to deliver fuel to all three entry points. In instances that pressurized fuel is delivered by timed injection to the inlet valve port of the combustion chamber during the time that the intake port or valve is open, increased air intake and volumetric efficiency is achieved by imparting fuel momentum to cause air-pumping for developing greater air density in the combustion chamber.

In such instances the fuel is delivered at a velocity that considerably exceeds the air velocity to thus induce acceleration of air into the combustion chamber. This advantage can be compounded by controlling the amount of fuel that enters the combustion chamber to be less than would initiate or sustain combustion by spark ignition. Such lean fuel-air mixtures however can readily be ignited by fuel injection and ignition by the injector embodiments described herein, which provides for assured ignition and rapid penetration by combusting fuel into the lean fuel-air mixture developed by timed port fuel injection.

Additional power may be provided by direct cylinder injection through a separate direct fuel injector that adds fuel to the combustion initiated by an injector such as the injector 100 described above with reference to FIG. 1A. Direct injection from one or more separate direct cylinder injectors into combustion initiated by the injector assures rapid and complete combustion within excess air and avoids the heat loss usually associated with separate direct injection and spark ignition components that require the fuel to swirl, ricocheting and/or rebounding from combustion chamber surfaces and then to combust on or near surfaces around the spark ignition source.

In larger engine applications, for high speed engine operation, and in instances that it is desired to minimize electrical current requirements and heat generation in solenoid 386 it is particularly desirable to combine mechanical cam actuated motion with solenoid operation of plunger assembly 378 and 372. This enables the primary motion of plunger 378 to be provided by a shaft cam. After the initial valve action of ball 366 is established by cam action for fuel delivery adequate for idle operation of the engine, increased fuel delivery and power production is provided by increasing the delivery pressure and/or "hold-on time" by continuing to hold plunger against stop 390 as a result of creating a relatively small current flow in annular solenoid winding 386. Thus, assured valve operation and precise control of increased power is provided by prolonging the hold-on time of plunger 378 by solenoid action following quick opening of ball 366 by cam action.

Figure 3B:
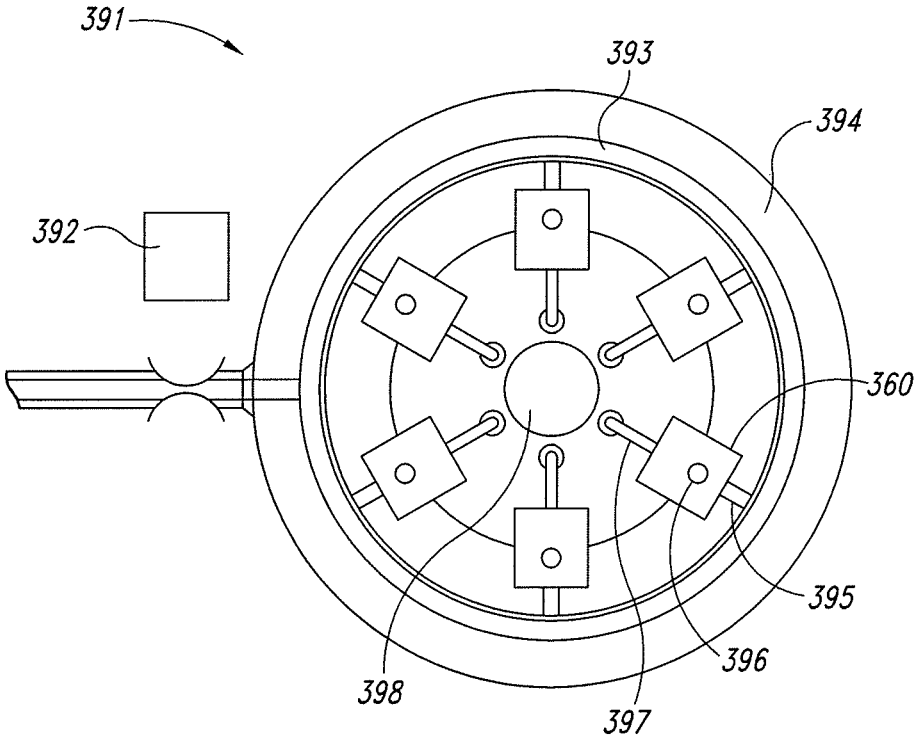
FIG. 3B is a plan partial view of a distribution assembly.

FIG. 3B is a plan partial view of a distribution assembly 391 configured in accordance with an embodiment of the disclosure. According to aspects of the disclosure, engines with multiple combustion chambers are provided with precisely timed delivery of fuel and/or coolant by the arrangement subassemblies 360 in the assembly 391 as shown in the schematic fuel control circuit layout of FIG. 3B. In this illustrative instance, six subassemblies 360 are located at equal angular spacing within a housing 394. The housing 394 provides conduits for pressurized fuel to each subassembly inlet 395 through a manifold 393. A cam on a rotating camshaft intermittently actuates corresponding push rod assemblies 397 to provide for precise flow of fuel from inlet 395 to a corresponding outlet 396, which in turn delivers to the fuel or coolant the desired intake valve port and/or combustion chamber directly or through the injector as shown in FIG. 1A. In certain embodiments, the housing 394 is preferably adaptively adjusted with respect to an angular position relative to the cam to provide spark and injection advance in response to adaptive optimization algorithms provided by a controller 392 as shown.

In certain embodiments, the controller 392 can provide adaptive optimization of each combustion chamber's fuel-delivery and spark-ignition events as a further improvement in efficiency, power production, operational smoothness, fail-safe provisions, and longevity of engine components. Moreover, the controller 392 can record sensor indications including the angular velocity of the cam to determine the time between each cylinder's torque development to derive positive and negative engine acceleration as a function of adaptive fuel-injection and spark-ignition data in order to determine adjustments needed for optimizing desired engine operation outcomes. For example, it is generally desired to produce the greatest torque with the least fuel consumption. However, in areas such as congested city streets where oxides of nitrogen emissions are objectionable, adaptive fuel injection and ignition timing provides maximum torque without allowing peak combustion temperatures to reach 2,200° C. (4,000° F.). This can be achieved by the disclosure of embodiments described in detail herein.

The fuels and/or coolants that are supplied to the injectors disclosed herein can be stored in any suitable corresponding storage containers. Moreover, these fuels or coolants can be pressurized to aid in the adaptive delivery of these fuels and/or coolants. In one embodiment, these fuels or coolants can be pressurized in the storage container without the use of a pump. For example, one or more chemical reactions can be controlled or otherwise allowed to occur to pressurize the corresponding fuels or coolants. More specifically, in certain embodiments, the storage container can be configured to store a pressurizing substance such as hydrogen, propane, or ammonia over diesel fuel. As such, in one embodiment the propane can be used as an expansive fluid by changing phase in response to energy that is added to the propane to produce propane vapor and consequently pressurize the diesel fuel storage vessel. In other embodiments, liquid hydrogen can be added to diesel fuel storage vessel. The liquid hydrogen can accordingly remove heat from the diesel fuel and pressurize the diesel fuel. Moreover, in still further embodiments ammonia or mothballs can be added to a fuel or coolant to accordingly dissociate and pressurize the fuel or coolant. Although several illustrative embodiments are disclosed above, one of ordinary skill in the art will appreciate that these are non-limiting embodiments and that various other processes and reactions including controlled gas releases from hydride or adsorptive media are suitable for pressurizing the fuel or coolant can be used.

According to additional features of the embodiments disclosed herein, injectors having the features described above can be used to inject and ignite fuels at relatively low pressures. For example, in one embodiment, such injectors can be used for operating conditions that do not exceed approximately 10 to 15 atmospheres (150 to 300 psi) over the max compression pressure of the engine. In other embodiments, however, these injectors can be used for operating conditions that are less than or that exceed approximately 150 to 300 psi over the max compression pressure of the engine. Accordingly, these injectors provide positive ignition and can be adaptively used for fuels that do not have a cetane rating requirement for the fuels.

According to yet additional features of the embodiments described above, the injectors are particularly suited to adaptively control the injection and ignition of various fuels and/or coolants. For example, the separate and electrically isolated first and second flow passages allow for different fuels to be injected and ignited. Moreover, these passages can produce different distribution or spray patterns of the fuels or coolants in the combustion chamber. What's more, the multiple discrete channels in the second flow passage can provide further adaptability or variation for the delivery, distribution, and/or ignition of various fuels and coolants. Injectors configured in accordance with embodiments of the disclosure can further be configured to adaptively adjust fuel/coolant delivery and/or ignition based at least upon the valve assembly operation, ignition energy transfer and/or operation, the type of fuel or coolant injected, as well as the pressure or temperature of the fuel or coolant that is injected.

In certain embodiment, an injector configured in accordance with an embodiment of the disclosure includes an injector body having a base portion configured to receive a first fuel and at least one of a second fuel and a coolant into the body, and a nozzle portion coupled to the base portion. The nozzle portion is configured to be positioned proximate to a combustion chamber for injecting the first fuel and at least one of the second fuel and the coolant into the combustion chamber. The injector can also include a valve seal positioned at or proximate to the nozzle portion, an ignition rod extending from the base portion to the nozzle portion, and a valve coaxially disposed over at least a portion of the ignition rod. The valve includes a sealing head that moves between an open position in which the sealing head is spaced apart from the valve seal, and a closed position in which the sealing head at least partially contacts the valve seal. The injector further includes a first flow channel extending longitudinally through a center portion of the ignition rod, and a second flow channel fluidly separated from the first flow channel and extending longitudinally through the body adjacent to the valve. The first flow channel is configured to deliver the first fuel to the nozzle portion, and the second flow channel is configured to deliver at least one of the second fuel and the coolant to the nozzle portion. The Injector further includes a first coupling fluidly coupled to the first flow channel to deliver the first fuel to the first flow channel, and a second coupling fluidly coupled to the second flow channel to deliver at least one of the second fuel and the coolant to the second flow channel.

According to certain embodiments of this injector the first ignition energy is greater than the second ignition energy, the ignition feature is concentric with the ignition rod. Moreover, the injector can also include a pressurized fuel source operably coupled to the injector body, wherein the pressurized fuel source stores the first fuel above an ambient pressure. The pressurized fuel source can at least partially pressurize the first fuel without the aid of a pump, and the pressurized fuel source can comprise a storage container that stores the first fuel, and wherein the storage container contains a chemical reaction that at least partially pressurizes the first fuel. The injector can also include a capacitor carried by the injector body and configured to store ignition energy to ignite at least one of the first fuel and the second fuel, wherein the ignition energy is harvested from the combustion chamber. The injector can further include a third coupling fluidly coupled to the third flow channel to deliver at least one of the third fuel and the second coolant to the third flow channel, as well as an ignition energy conductor operably coupled to the ignition conductor via the first fuel inlet, as well as an ignition energy source carried by the body. In certain embodiments, the first ignition energy is greater than the second ignition energy.

A method of operating a fuel injector in accordance with embodiments of the disclosure includes introducing a first fuel into a first flow channel in a body of the injector, dispensing the first fuel from first flow channel into a combustion chamber, activating a first ignition feature to at least partially ignite the first fuel, introducing at least one of a second fuel and a coolant into a second flow channel in the body, wherein the second flow channel is fluidly separated from the first flow channel, and actuating a valve to dispense at least one of the second fuel and the coolant from the second flow channel into the combustion chamber. The method can also include activating a second ignition feature to at least partially ignite the second fuel after the valve dispenses the second fuel. The first flow channel can be electrically isolated from the second flow channel, and wherein activating the first ignition feature includes applying a first voltage to the ignition feature, and activating the second ignition feature includes activating a second voltage to the second ignition feature, the second voltage being less than the first voltage. Moreover, actuating the valve comprises energizing a solenoid winding to induce movement of the valve from a closed position to an open position. In addition, the solenoid winding is a first solenoid winding and wherein the method can further comprise inducing a voltage in a second solenoid winding proximate to the first solenoid winding, and transmitting the voltage to the second ignition feature. Moreover, actuating the valve to dispense at least one of the second fuel and the coolant comprises actuating the valve in response to a change in at least one operating condition. Furthermore, the operating condition comprises at least one of the following: an increased power requirement, a decreased power requirement, a combustion chamber temperature, a combustion chamber pressure, a combustion chamber light value, and a combustion chamber acoustical value. The method can also include adaptively controlling at least one of dispensing the first fuel and actuating the valve to dispense at least one of the second fuel and the coolant based on one or more detected combustion chamber properties. In addition, actuating the valve comprises actuating the valve to dispense the coolant in response to a predetermined temperature in the combustion chamber, and dispensing the first fuel from first flow channel into the combustion chamber comprises dispensing a first non-cetane rated fuel from first flow channel into the combustion chamber.

The present application incorporates by reference in its entirety the subject matter of the following applications: U.S. Provisional Application No. 61/237,466, filed Aug. 27, 2009 and titled "MULTIFUEL MULTIBURST"; U.S. Provisional Patent Application No. 61/407,437, filed Oct. 27, 2010 and titled "FUEL INJECTOR SUITABLE FOR INJECTING A PLURALITY OF DIFFERENT FUELS INTO A COMBUSTION"; U.S. Provisional Application No. 61/304,403, filed Feb. 13, 2010 and titled "FULL SPECTRUM ENERGY AND RESOURCE INDEPENDENCE"; U.S. Provisional Application No. 61/312,100, filed Mar. 9, 2010 and titled "SYSTEM AND METHOD FOR PROVIDING HIGH VOLTAGE RF SHIELDING, FOR EXAMPLE, FOR USE WITH A FUEL INJECTOR"; U.S. Provisional Application No. 61/237,425, filed Aug. 27, 2009 and titled "OXYGENATED FUEL PRODUCTION"; U.S. Provisional Application No. 61/237,479, filed Aug. 27, 2009 and titled "FULL SPECTRUM ENERGY"; U.S. patent application Ser. No. 12/841,170, filed Jul. 21, 2010, now U.S. Pat. No. 8,555,860, and titled "INTEGRATED FUEL INJECTORS AND IGNITERS AND ASSOCIATED METHODS OF USE AND MANUFACTURE"; U.S. patent application Ser. No. 12/804,510, filed Jul. 21, 2010, now U.S. Pat. No. 8,074,625, and titled "FUEL INJECTOR ACTUATOR ASSEMBLIES AND ASSOCIATED METHODS OF USE AND MANUFACTURE"; U.S. patent application Ser. No. 12/841,146, filed Jul. 21, 2010, now U.S. Pat. No. 8,413,634, and titled "INTEGRATED FUEL INJECTOR IGNITERS WITH CONDUCTIVE CABLE ASSEMBLIES"; U.S. patent application Ser. No. 12/841,149, filed Jul. 21, 2010, now U.S. Pat. No. 8,365,700, and titled "SHAPING A FUEL CHARGE IN A COMBUSTION CHAMBER WITH MULTIPLE DRIVERS AND/OR IONIZATION CONTROL"; U.S. patent application Ser. No. 12/841,135, filed Jul. 21, 2010, now U.S. Pat. No. 8,192,852, and titled "CERAMIC INSULATOR AND METHODS OF USE AND MANUFACTURE THEREOF"; U.S. patent application Ser. No. 12/804,509, filed Jul. 21, 2010, now U.S. Pat. No. 8,561,598, and titled "METHOD AND SYSTEM OF THERMOCHEMICAL REGENERATION TO PROVIDE OXYGENATED FUEL, FOR EXAMPLE, WITH FUEL-COOLED FUEL INJECTORS"; U.S. patent application Ser. No. 12/804,508, filed Jul. 21, 2010, now U.S. Pat. No. 8,387,599, and titled "METHODS AND SYSTEMS FOR REDUCING THE FORMATION OF OXIDES OF NITROGEN DURING COMBUSTION IN ENGINES"; U.S. patent application Ser. No. 12/581,825, filed Oct. 19, 2009, now U.S. Pat. No. 8,297,254, and titled "MULTIFUEL STORAGE, METERING AND IGNITION SYSTEM"; U.S. patent application Ser. No. 12/653,085, filed Dec. 7, 2009; now U.S. Pat. No. 8,635,985, and titled "INTEGRATED FUEL INJECTORS AND IGNITERS AND ASSOCIATED METHODS OF USE AND MANUFACTURE"; U.S. patent application Ser. No. 12/006,774, filed Jan. 7, 2008 (now U.S. Pat. No. 7,628,137) and titled "MULTIFUEL STORAGE, METERING AND IGNITION SYSTEM"; U.S. patent application Ser. No. 12/913,749, filed Oct. 27, 2010, now U.S. Pat. No. 8,733,331, and titled "ADAPTIVE CONTROL SYSTEM FOR FUEL INJECTORS AND IGNITERS"; PCT Application No. PCT/US09/67044, filed Dec. 7, 2009 and titled "INTEGRATED FUEL INJECTORS AND IGNITERS AND ASSOCIATED METHODS OF USE AND MANUFACTURE"; and U.S. patent application Ser. No. 12/961,453, filed Dec. 6, 2010, now U.S. Pat. No. 8,091,528, and titled "INTEGRATED FUEL INJECTOR IGNITERS HAVING FORCE GENERATING ASSEMBLIES FOR INJECTING AND IGNITING FUEL AND ASSOCIATED METHODS OF USE AND MANUFACTURE".

From the foregoing, it will be appreciated that specific embodiments of the disclosure have been described herein for purposes of illustration, but that various modifications may be made without deviating from the spirit and scope of the invention. For example, the dielectric strength of the insulators disclosed herein may be altered or varied to include alternative materials and processing means. The actuators and drivers may be varied depending on fuel and/or the use of the corresponding injectors. Moreover, components of the injector may be varied including for example, the electrodes, the optics, the actuators, the valves, and the nozzles or the bodies may be made from alternative materials or may include alternative configurations than those shown and described and still be within the spirit of the disclosure.

Unless the context clearly requires otherwise, throughout the description and the claims, the words "comprise," "comprising," and the like are to be construed in an inclusive sense as opposed to an exclusive or exhaustive sense; that is to say, in a sense of "including, but not limited to." Words using the singular or plural number also include the plural or singular number, respectively. When the claims use the word "or" in reference to a list of two or more items, that word covers all of the following interpretations of the word: any of the items in the list, all of the items in the list, and any combination of the items in the list. In addition, the various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the disclosure can be modified, if necessary, to employ fuel injectors and ignition devices with various configurations, and concepts of the various patents, applications, and publications to provide yet further embodiments of the disclosure.

These and other changes can be made to the disclosure in light of the above-detailed description. In general, in the following claims, the terms used should not be construed to limit the disclosure to the specific embodiments disclosed in the specification and the claims, but should be construed to include all systems and methods that operate in accordance with the claims. Accordingly, the invention is not limited by the disclosure, but instead its scope is to be determined broadly by the following claims.

I claim:

1. An injector comprising:

an injector body including— a base portion configured to receive a first fuel and at least one of a second fuel and a coolant into the body; and a nozzle portion coupled to the base portion, wherein the nozzle portion is configured to be positioned proximate to a combustion chamber for injecting the first fuel and at least one of the second fuel and the coolant into the combustion chamber;

a valve seal positioned at or proximate to the nozzle portion;

an ignition rod extending from the base portion to the nozzle portion;

a valve coaxially disposed over at least a portion of the ignition rod, wherein the valve includes a sealing head and moves between an open position in which the sealing head is spaced apart from the valve seal, and a closed position in which the sealing head at least partially contacts the valve seal;

a first flow channel extending longitudinally through a center portion of the ignition rod, wherein the first flow channel is configured to deliver the first fuel to the nozzle portion;

a second flow channel fluidly separated from the first flow channel and extending longitudinally through the body and disposed radially outward from the valve and the first flow channel, wherein the second flow channel is configured to deliver at least one of the second fuel and the coolant to the nozzle portion when the valve is in the open position;

a first coupling fluidly coupled to the first flow channel to deliver the first fuel to the first flow channel; and a second coupling fluidly coupled to the second flow channel to deliver at least one of the second fuel and the coolant to the second flow channel.

2. The injector of claim 1, further comprising an ignition feature proximate to the ignition rod at the nozzle portion, wherein second flow channel delivers at least one of the second fuel and the coolant past the second ignition feature.

3. The injector of claim 2 further comprising:

a first ignition energy source coupled to the ignition rod for supplying a first ignition energy to ignite the first fuel; and a second ignition energy source coupled to the ignition feature for supplying a second ignition energy to ignite the second fuel.

4. The injector of claim 1 wherein the nozzle portion injects the first fuel in a first injection pattern into the combustion chamber, and the nozzle portion injects at least one of the second fuel and the coolant in a second injection pattern into the combustion chamber, and wherein the first injection pattern is different than the second injection pattern.

5. The injector of claim 1, further comprising a force generator assembly that one of fuels flows through force generator assembly that moves the valve between the open and closed positions, and wherein the second flow channel extends through at least a portion of the force generator assembly.

6. The injector of claim 1 wherein the valve moves longitudinally through the injector body as the valve moves between the open and closed positions to dispense at least one of the second fuel and the coolant from the second flow channel into the combustion chamber.

7. The injector of claim 1, further comprising a third flow channel fluidly separate from the first flow channel and the second flow channel, and wherein the third flow channels is configured to deliver at least one of a third fuel and a second coolant to the nozzle portion.

8. A method of adaptively operating a fuel injector, the method comprising:

introducing at least one of a first fuel and a first coolant into a first flow channel in a body of the injector;

dispensing at least one of the first fuel and the first coolant from first flow channel into a combustion chamber in a first distribution pattern;

introducing at least one of a second fuel and a second coolant into a second flow channel in the body, wherein the second flow channel is fluidly separated from the first flow channel and is disposed radially outward from a valve carried by the body and the first flow channel, wherein the valve is movable between a closed position and an open position to introduce at least one of the second fuel and the coolant into a combustion chamber through the second channel;

dispensing at least one of the second fuel and the second coolant from the second flow channel into the combustion chamber in a second distribution pattern, wherein the second distribution pattern is different from the first distribution pattern;

when dispensing at least one of the first fuel and the second fuel, at least partially igniting the first fuel or the second fuel with an ignition feature carried by the body of the injector;

introducing at least one of a third fuel and a third coolant into a third flow channel in the body, wherein the third flow channel is fluidly separated from the first and second flow channels; and dispensing at least one of the third fuel and the third coolant from the third flow channel into the combustion chamber, wherein dispensing at least one of the third fuel and the third coolant from the third flow channel into the combustion chamber comprises dispensing at least one of the third fuel and the third coolant into the combustion chamber in the second distribution pattern.

9. A method of adaptively operating a fuel injector, the method comprising:

introducing at least one of a first fuel and a first coolant into a first flow channel in a body of the injector;

dispensing at least one of the first fuel and the first coolant from first flow channel into a combustion chamber in a first distribution pattern;

introducing at least one of a second fuel and a second coolant into a second flow channel in the body, wherein the second flow channel is fluidly separated from the first flow channel and is disposed radially outward from a valve carried by the body and the first flow channel, wherein the valve is movable between a closed position and an open position to introduce at least one of the second fuel and the coolant into a combustion chamber through the second channel;

dispensing at least one of the second fuel and the second coolant from the second flow channel into the combustion chamber in a second distribution pattern, wherein the second distribution pattern is different from the first distribution pattern; and when dispensing at least one of the first fuel and the second fuel, at least partially igniting the first fuel or the second fuel with an ignition feature carried by the body of the infector;

introducing at least one of a third fuel and a third coolant into a third flow channel in the body, wherein the third flow channel is fluidly separated from the first and second flow channels; and dispensing at least one of the third fuel and the third coolant from the third flow channel into the combustion chamber, wherein dispensing at least one of the third fuel and the third coolant from the third flow channel into the combustion chamber comprises dispensing at least one of the third fuel and the third coolant into the combustion chamber in a third distribution pattern, and wherein the third distribution pattern is different from the first and second distribution patterns.

* * * * *